US005909727A

United States Patent [19]

Nakagawa

[11] Patent Number: 5,909,727

[45] Date of Patent: Jun. 8, 1999

[54] EVAPORATED FUEL TREATMENT DEVICE OF AN ENGINE

[75] Inventor: Norihisa Nakagawa, Numazu, Japan

[73] Assignee: Toyota Jidosha Kabushiki Kaisha, Aichi-ken, Japan

[21] Appl. No.: 09/089,735

[22] Filed: Jun. 3, 1998

[30] Foreign Application Priority Data

Jun. 4, 1997 [JP] Japan ..... 9-146392

[51] Int. Cl.[6] ..... F02M 37/04

[52] U.S. Cl. ..... 123/520; 123/516; 123/357

[58] Field of Search ..... 123/520, 521, 123/519, 518, 516, 198 D, 357

[56] References Cited

U.S. PATENT DOCUMENTS

| | | | |
|---|---|---|---|
| 4,961,412 | 10/1990 | Furuyama | 123/357 |
| 5,476,081 | 12/1995 | Okawa | 123/520 |
| 5,520,160 | 5/1996 | Aota | 123/520 |
| 5,535,719 | 7/1996 | Morikawa | 123/520 |
| 5,609,142 | 3/1997 | Osanai | 123/357 |
| 5,680,849 | 10/1997 | Morikawa | 123/357 |
| 5,696,317 | 12/1997 | Rychlick | 123/520 |
| 5,699,778 | 12/1997 | Muraguchi | 123/520 |

FOREIGN PATENT DOCUMENTS

| | | |
|---|---|---|
| 62-206262 | 9/1987 | Japan . |
| 5248315 | 9/1993 | Japan . |
| 617716 | 1/1994 | Japan . |
| 6200804 | 7/1994 | Japan . |
| 7293362 | 11/1995 | Japan . |

*Primary Examiner*—Carl S. Miller
*Attorney, Agent, or Firm*—Kenyon & Kenyon

[57] ABSTRACT

An evaporated fuel treatment device comprising a purge control valve for controlling an amount of fuel vapor fed into the intake passage from a charcoal canister. The fuel vapor concentration is divided into a first fuel vapor concentration changing proportionally to a purge rate of the fuel vapor and a second fuel vapor concentration changing without regard as to the purge rate of the fuel vapor. The first fuel vapor concentration per unit purge rate is reduced following a reduction in the amount of fuel absorbed in the canister. At this time, the second fuel vapor concentration is calculated from the amount of deviation of the air-fuel ratio from the target air-fuel ratio.

14 Claims, 13 Drawing Sheets

EVAPORATED FUEL TREATMENT DEVICE OF AN ENGINE

BACKGROUND OF THE INVENTION

1. Field of the Invention

The present invention relates to an evaporated fuel treatment device of an engine.

2. Description of the Related Art

Known in the art is an internal combustion engine provided with a canister for temporarily storing evaporated fuel generated in a fuel tank and a purge control valve for controlling the amount of purge of the fuel vapor to be purged from the canister to the inside of an intake passage, performing feedback control on the air-fuel ratio so that the air-fuel ratio becomes the target air-fuel ratio, calculating the concentration of fuel vapor per unit purge rate from the amount of deviation of the air-fuel ratio from the target air-fuel ratio, finding the current concentration of fuel vapor from the concentration of fuel vapor per unit purge rate and the current purge rate, and correcting the amount of fuel injection based on the concentration of fuel vapor (see Japanese Unexamined Patent Publication (Kokai) No. 7-293362.

That is, when trying to purge fuel absorbed in a canister into the intake passage, the amount of fuel vapor which is purged is proportional to the purge rate, therefore the concentration of the fuel vapor in the intake air is also proportional to the purge rate. That is, the concentration of fuel vapor in the intake air increases in proportion to an increase of the purge rate. Accordingly, if the concentration of fuel vapor per unit purge rate is found, it is possible to find the concentration of fuel vapor at that time, no matter how the purge rate changes, by multiplying the purge rate with the concentration of fuel vapor per unit purge rate. Consequently, even in the above internal combustion engine, the concentration of the fuel vapor per unit purge rate is found from the amount of deviation of the air-fuel ratio from the target air-fuel ratio.

By finding the concentration of fuel vapor per unit purge rate in this way, it is possible to accurately find the concentration of fuel vapor at that time even if the purge rate changes so long as the concentration of fuel vapor is proportional to the purge rate, therefore if the amount of fuel injection is corrected based on the concentration of fuel vapor, it would become possible to maintain the air-fuel ratio at the target air-fuel ratio no matter how the engine operating state changes.

The actual concentration of fuel vapor however includes a portion which changes proportional to the purge rate as explained above and a portion which is not proportional to the purge rate. If there is a portion which is not proportional to the purge rate in this way, the product of the concentration of the fuel vapor per unit purge rate and the purge rate will no longer accurately express the concentration of the fuel vapor. If the amount of fuel injection is corrected based on this concentration of fuel vapor, the problem will arise of the air-fuel ratio deviating from the target air-fuel ratio.

SUMMARY OF THE INVENTION

An object of the present invention is to provide an evaporated fuel treatment device capable of suppressing the fluctuation of an air-fuel ratio occurring based on a change in the concentration of fuel vapor.

According to the present invention, there is provided an evaporated fuel treatment device for an engine provided with an intake passage, comprising a canister containing activated carbon for temporarily storing evaporated fuel; a purge control valve for controlling an amount of purge of fuel vapor to be purged from the canister into the intake passage, the concentration of the fuel vapor which is purged being divided into a first fuel vapor concentration which changes proportionally to a purge rate of the fuel vapor and a second fuel vapor concentration which changes without regard as to the purge rate of the fuel vapor; air-fuel ratio detecting means for detecting the air-fuel ratio; feedback control means for feedback control of the air-fuel ratio so that the air-fuel ratio becomes a target air-fuel ratio; fuel vapor concentration reducing means for reducing the first fuel vapor concentration per unit purge rate to follow a reduction in the amount of fuel absorbed in the canister when the fuel vapor is being purged; fuel vapor concentration calculating means for calculating the second fuel vapor concentration from the amount of deviation of the air-fuel ratio from the target air-fuel ratio caused when reducing the first fuel vapor concentration per unit purge rate by the fuel vapor concentration reducing means; and correcting means for correcting an amount of fuel supplied based on the first fuel vapor concentration and the second fuel vapor concentration.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
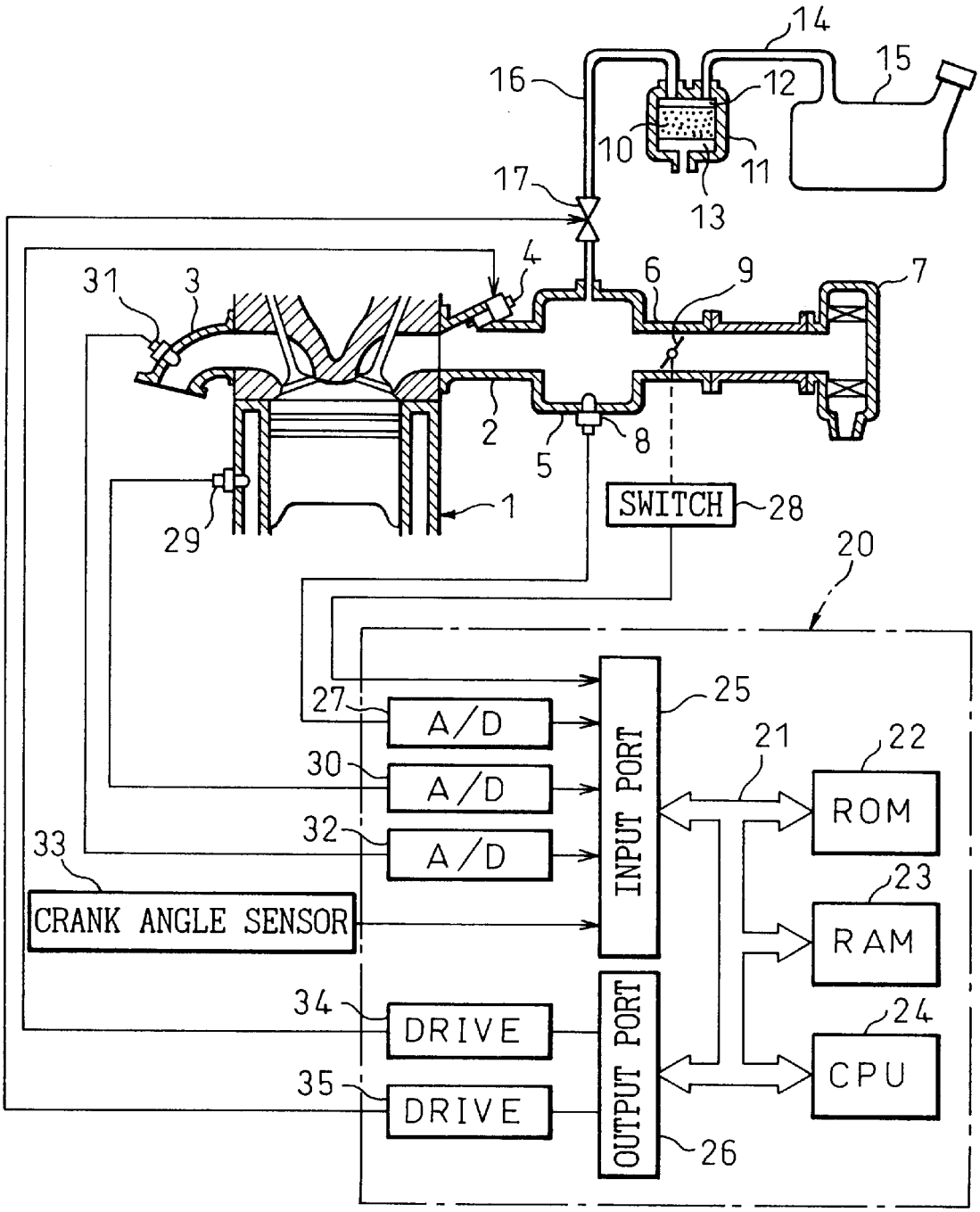
FIG. 1 is an overall view of an internal combustion engine.

Referring to FIG. 1, 1 is an engine body, 2 an intake pipe, 3 an exhaust manifold, and 4 a fuel injector attached to each of the intake pipes 2. Each intake pipe 2 is connected to a common surge tank 5. The surge tank 5 is connected through an intake duct 6 to an air cleaner 7. In the surge tank 5 is arranged a pressure sensor 8, while in the induct duct 6 is arranged a throttle valve 9. Further, as shown in. FIG. 1, the internal combustion engine has disposed in it a canister 11 containing activated charcoal 10. The canister 11 has a fuel vapor chamber 12 and an atmospheric chamber 13 on the two sides of the activated carbon 10. The fuel vapor chamber 12 on the one hand is connected through a conduit 14 to a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the fuel vapor is purged through the conduit 16 to the inside of the surge tank 5.

The electronic control unit 20 is comprised of a digital computer and is provided with a read only memory (ROM) 22, a random access memory (RAM) 23, a microprocessor (CPU) 24, an input port 25, and an output port 26 connected to each other through a bidirectional bus 21. The pressure sensor 8 generates an output voltage proportional to the absolute pressure in the surge tank 5. This output voltage is input through an AD converter 27 to the input port 25. The throttle valve 9 has attached to it a throttle switch 28 which is turned on when the throttle valve 9 is at the idling opening. The output signal of the throttle switch 28 is input to the input port 25. The engine body 1 has attached to it a water temperature sensor 29 for generating an output voltage proportional to the coolant water temperature of the engine. The output voltage of the water temperature sensor 29 is input through the corresponding AD converter 30 to the input port 25. The exhaust manifold 3 has an air-fuel ratio sensor 31 attached to it. The output signal of the air-fuel ratio sensor 31 is input through the corresponding AD converter 32 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuits 34 and 35 to the fuel injectors 4 and the purge control valve 17.

In the internal combustion engine shown in FIG. 1, the fuel injection time TAU is calculated based on the following equation (1) when there is no purge action of the fuel vapor from the canister 11 and the fuel injection time TAU is calculated based on the following equation (2) when there is a purge action:

$$TAU=TP\cdot FW\cdot(FAF+KGj) \quad (1)$$

$$TAU=TP\cdot FW\cdot(FAF+KGj+FPG+KGPGj) \quad (2)$$

where, the coefficients show the following:

TP: basic fuel injection time

FW: correction coefficient

FAF: feedback correction coefficient

KGj: learning coefficient of air-fuel ratio

FPG: purge air-fuel ratio correction coefficient (hereinafter referred to as the purge A/F correction coefficient)

KGPGj: learning coefficient of vapor concentration

The basic fuel injection time TP is the experimentally found injection time required for making the air-fuel ratio the target air-fuel ratio. The basic fuel injection time TP is stored in advance in the ROM 22 as a function of the absolute pressure PM in the surge tank 5 and the engine speed N.

The correction coefficient FW expresses the engine warmup increase coefficient and the acceleration increase coefficient all together. When no upward correction is needed, FW is made 1.0.

The feedback correction coefficient FAF is set to control the air-fuel ratio to the target air-fuel ratio based on the output signal of the air-fuel ratio sensor 31.

The learning coefficient KGj is set for learning the amount of deviation of the air-fuel ratio from the target air-fuel ratio when the purge action is stopped.

The purge A/F correction coefficient FPG expresses the first concentration of fuel vapor changing proportionally to the purge rate.

The vapor correction learning coefficient KGPGj expresses the second concentration of fuel vapor changing without regard as to the purge rate.

As explained above, however, the feedback control coefficient FAF is for controlling the air-fuel ratio to the target air-fuel ratio based on the output signal of the air-fuel ratio sensor 31. In this case, as the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereafter. Note that when the target air-fuel ratio is the stoichiometric air-fuel ratio, as the air-fuel ratio sensor 31, a sensor whose output voltage changes in accordance with the concentration of oxygen in the exhaust gas is used, therefore hereinafter the air-fuel ratio sensor 31 will be referred to as an $O_2$ sensor. This $O_2$ sensor 31 generates an output voltage of about 0.9 V when the air-fuel ratio is rich and generates an output voltage of about 0.1 V when the air-fuel ratio is lean.

Figure 2:
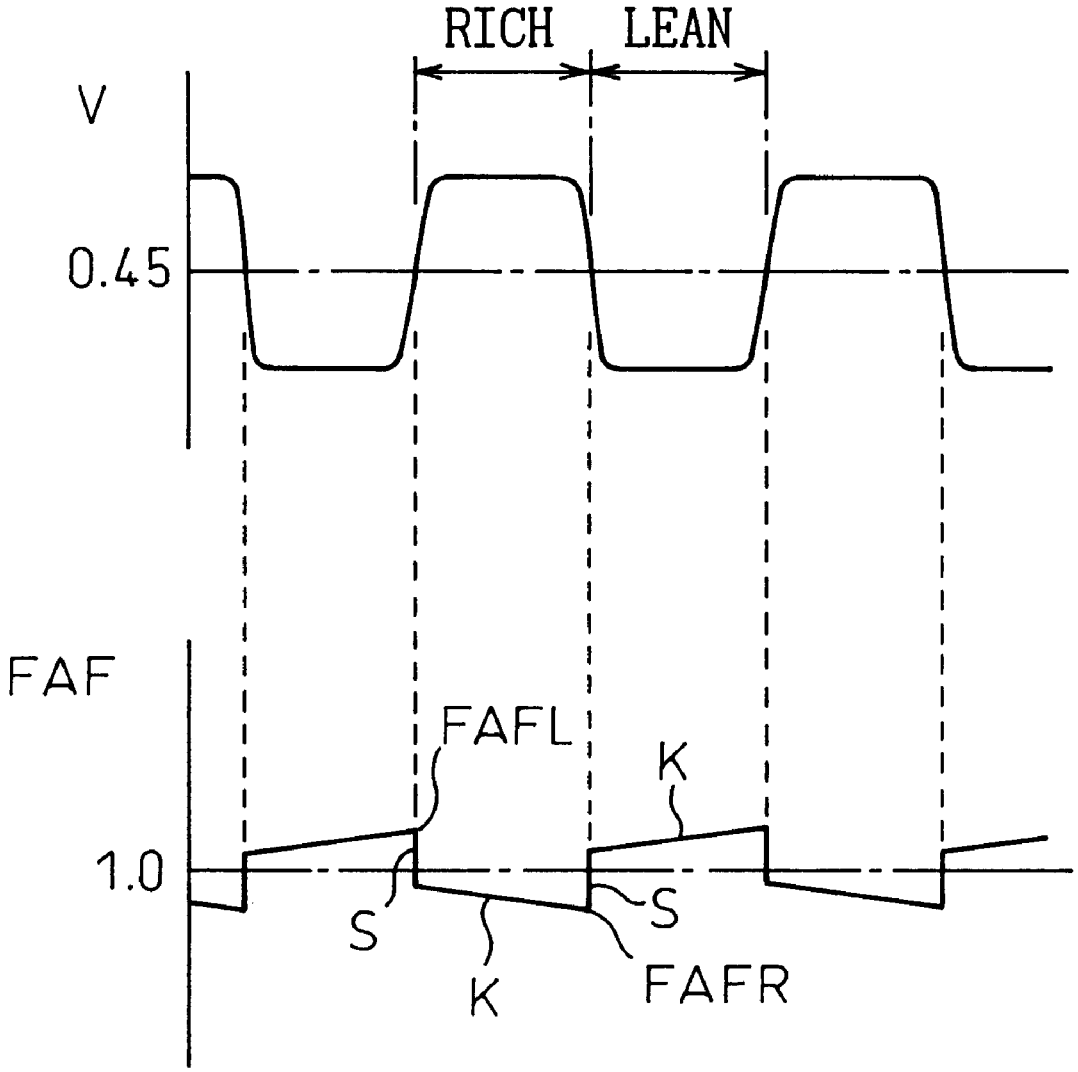
FIG. 2 is a view of the changes in the air-fuel ratio feedback correction coefficient FAF.

FIG. 2 shows the relationship between the output voltage V of the $O_2$ sensor 31 and the feedback control coefficient FAF when the air-fuel ratio is maintained at the target air-fuel ratio. As shown in FIG. 2, when the output voltage V of the $O_2$ sensor 31 becomes higher than a reference voltage, for example, 0.45 V, that is, when the air-fuel ratio becomes rich, the feedback control coefficient FAF is rapidly reduced by the skip amount S, then is gradually reduced by the integration constant K. As opposed to this, when the output voltage V of the $O_2$ sensor 31 becomes lower than the reference voltage, that is, when the air-fuel ratio becomes lean, the feedback control coefficient FAF is rapidly increased by the skip amount S and then gradually increased by the integration constant K.

That is, when the air-fuel ratio becomes rich, the feedback control coefficient FAF is reduced, so the amount of fuel injection is reduced, while when the air-fuel ratio becomes lean, the feedback control coefficient FAF is increased and the amount of fuel injection is increased. Therefore, the air-fuel ratio is maintained at the stoichiometric air-fuel ratio. As shown in FIG. 2, at this time, the feedback control coefficient FAF fluctuates about a reference value, that is, 1.0.

Further, in FIG. 2, FAFL shows the value of the feedback control coefficient FAF when the air-fuel ratio changes from lean to rich, while FAFR shows the value of the feedback control coefficient FAF when the air-fuel ratio changes from rich to lean. In the embodiment of the present invention, as the average of the fluctuation of the feedback control coefficient FAF (hereinafter referred to simply as the average value), the average value between FAFL and FAFR is used.

Figure 3:
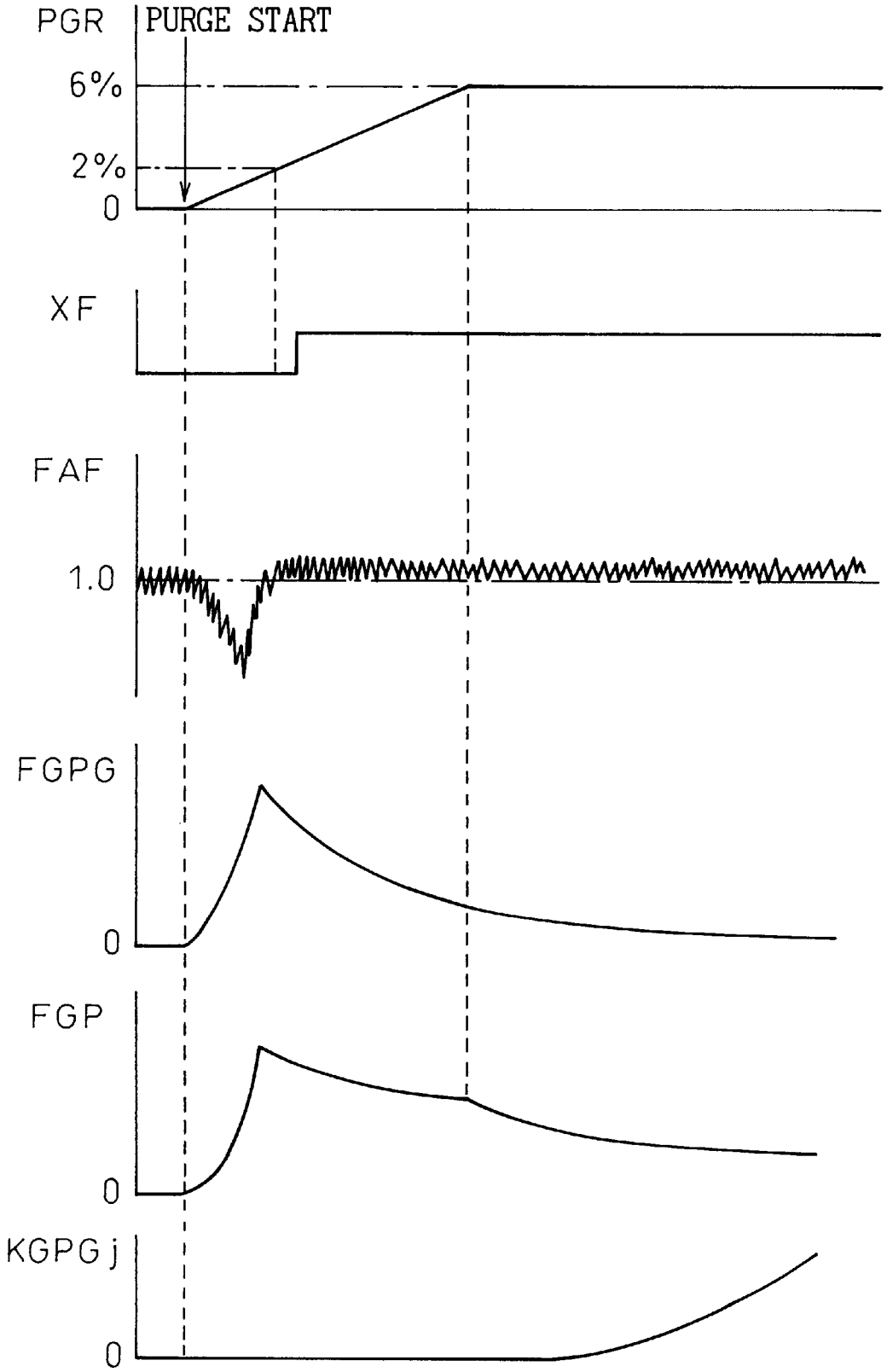
FIG. 3 is a view of changes in the FAF, FGPG, etc. at the time of start of a purge action.

Next, an explanation will be given of the purge control while referring to FIG. 3. Note that in FIG. 3, PGR shows the volume ratio of the amount of purge of the fuel vapor with respect to the amount of the intake air, that is, the purge rate, while FGPG shows the concentration of vapor per unit purge rate. The purge A/F correction coefficient FPG is obtained by multiplying the purge rate PGR with the FGPG. As shown in FIG. 3, in the embodiment of the present invention, when the purge action is started for the first time after the start of engine operation, the purge rate PGR is gradually increased from zero. When the purge rate PGR reaches a certain value, for example, 6 percent, the purge rate PGR is maintained constant.

The vapor concentration per unit purge rate FGPG is calculated based on the following formula every time the feedback correction coefficient FAF skips (S in FIG. 2):

$$\Delta FGPG=(1.0-FAFAV)/(2\cdot PGR)$$

$$FGPG=FGPG+\Delta FGPG$$

Here, ΔFGPG shows the update value of FGPG performed with every skip of FAF, while FAFAV shows the average value of the feedback control coefficient (=(FAFL+FAFR)/2).

As shown in FIG. 3, PFPG is made zero before the purge action is started. Next, when the purge action is started, since the air-fuel ratio becomes rich, the average value FAFAV of the feedback correction coefficient becomes smaller and as a result FGPG increases. If FGPG increases, the purge A/F correction coefficient FGP also increases along with this. During this time, the feedback correction coefficient FAF is increased by exactly the amount of increase of FGPG. When FGPG peaks, the feedback correction coefficient is returned to about 1.0. The value of FGPG at this time shows the true value of the vapor concentration per unit purge rate.

After FGPG peaks, the air-fuel ratio becomes slightly lean and FGPG continues to fall. This is because the amount of fuel absorbed in the canister 11 gradually falls along with the elapse of time.

Figure 4A:
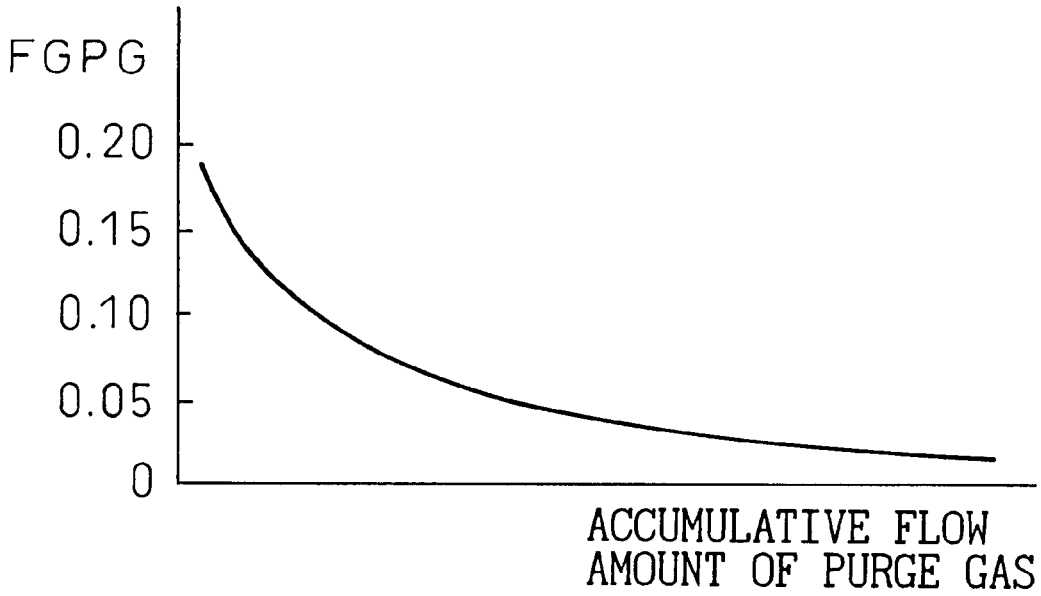
FIGS. 4A and 4B are views of the change in the FGPG and the relationship between the FGPG and ΔPG.

FIG. 4A shows an example of the relationship between the cumulative flow of purge gas and the FGPG when the fuel absorbed in the canister 11 is purged to the intake passage. As shown in FIG. 4A, the FGPG gradually falls as the cumulative flow of purge gas increases. In this case, if the cumulative flow of purge gas increases, the amount of fuel absorbed in the canister 1 falls along with it, so if the amount of fuel absorbed in the canister 11 falls, the FGPG falls along with it. That is, when the concentration of fuel vapor in the intake air changes due to the purge action of the fuel absorbed in the canister 11, the FGPG falls following the fall in the amount of fuel absorbed in the canister 11.

As explained at the start, however, when the concentration of fuel vapor in the intake air changes due to the purge action of the fuel absorbed in the canister 11, the concentration of fuel vapor in the intake air is proportional to the purge rate. In this case, by finding the vapor concentration FGPG per unit purge rate and correcting the amount of fuel injection by the product of this FGPG and the purge rate, that is, the purge A/F correction coefficient FGP, it is possible to maintain the air-fuel ratio at the target air-fuel ratio even if the engine operating state changes.

The actual concentration of fuel vapor, however, includes a portion which changes proportional to the purge rate and a portion not proportional to the purge rate. If there is a portion which is not proportional to the purge rate in this way, the product of the concentration of the fuel vapor per unit purge rate and the purge rate will no longer accurately express the concentration of the fuel vapor. Therefore, in this case, if the concentration of fuel vapor is found from the product of the concentration of fuel vapor per unit purge rate and the purge rate and the amount of fuel injection is corrected based on this concentration of fuel vapor, the air-fuel ratio will end up deviating from the target air-fuel ratio.

Next, an explanation will be given of two typical cases of change of the concentration of fuel vapor without regard to the purge rate.

For example, a little while after the engine starts being operated, a large amount of evaporated fuel will be produced in the fuel tank 15 due to the rise in the temperature of the fuel in the fuel tank 15 and vibration. The evaporated fuel produced in the fuel tank 15 flows through the conduit 16 directly into the intake passage. In this case, however, the fuel vapor is pushed out from the fuel tank 15 into the intake passage, so the amount of fuel vapor supplied from the fuel tank 15 to the intake passage is not dependent on the magnitude of the vacuum produced in the intake passage, but is dependent on the amount of the evaporated fuel produced in the fuel tank 15. Therefore, if the amount of fuel vapor directly supplied from the fuel tank 15 to the intake passage increases, the concentration of fuel vapor in the intake air will fluctuate widely in accordance with the amount of intake air without regard to the purge rate. When the amount of intake air is small, the concentration of fuel vapor will rise, while when the amount of intake air is large, the concentration of the fuel vapor will fall. This the first typical case.

The second typical case is that when the purge action is started before the learning of the air-fuel ratio is completed. For example, assume that when the purge action is started and the purge rate becomes 1 percent, the air-fuel ratio deviates 3 percent to the rich side and the feedback correction coefficient FAF is 0.97. At this time, the FGPG and purge A/F correction coefficient GFP become 0.03 so that FAF becomes 1.0. In this state, if the purge rate becomes 6 percent, the purge A/F correction coefficient FGP becomes 0.18(=0.03×6). That is, the air-fuel ratio will be corrected 18 percent even though in actuality the air-fuel ratio deviates by only 3 percent, therefore the air-fuel ratio will deviate widely from the target air-fuel ratio.

In the present invention, when there is a change in the concentration of fuel vapor not proportional to the purge rate, to prevent the air-fuel ratio from deviating from the target air-fuel ratio, the vapor concentration FGPG per unit purge rate is reduced to follow the reduction in the amount of fuel absorbed in the canister 11 so as to learn the amount of deviation of the air-fuel ratio from the target air-fuel ratio at this time.

Figure 4B:
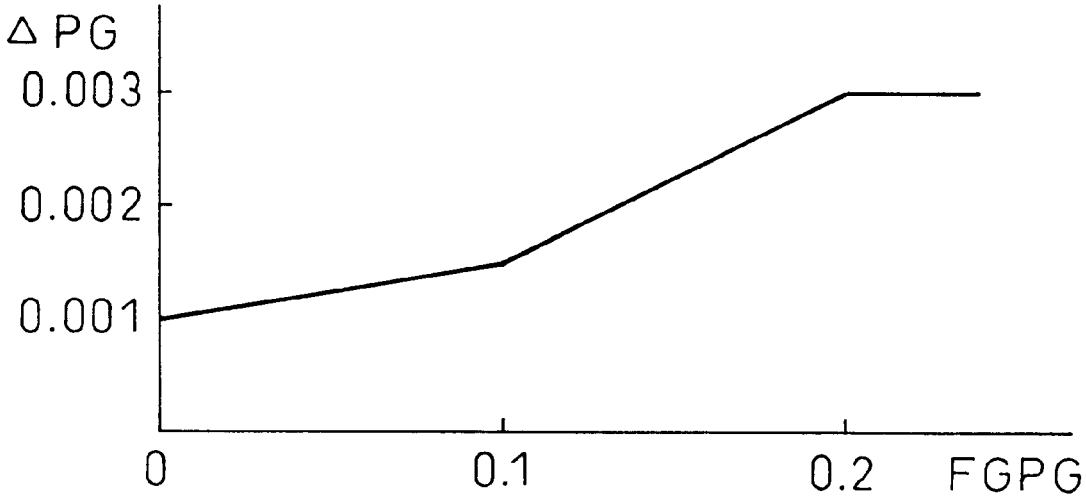

Specifically, in the embodiment of the present invention, the update amount ΔFGPG of FGPG is restricted to within the allowable range ΔPG shown in FIG. 4B. That is, when the concentration of fuel vapor is proportional to the purge rate, FGPG is reduced along with the passage of time as shown in FIG. 4A. At this time, the rate of fall of the FGPG, that is, the update amount ΔFGPG, becomes smaller the smaller the FGPG. Therefore, as shown in FIG. 4B, by making the allowable range ΔPG smaller as FGPG becomes smaller and limiting the update amount ΔFGPG of FGPG to within this allowable range ΔPG, the vapor concentration FGPG per unit purge rate is reduced following the reduction of the amount of fuel absorbed in the canister 11.

On the other hand, when FGPG is reduced in this way, if the air-fuel ratio deviates from the target air-fuel ratio, this will have been based on a change in the concentration of the fuel vapor not proportional to the purge rate. In the embodiment of the present invention, this concentration of fuel vapor not proportional to the purge rate is found from the following formulas:

$$\Delta KGPG=(1.0-FAFAV)/2$$

$$KGPGj=KGPGj+\Delta KGPG$$

Here, ΔKGPG shows the amount of update of the concentration of the fuel vapor performed with each skip of FAF, while KGPGj shows the vapor concentration learning coefficient as explained later. That is, when FGPG is reduced following the reduction in the amount of fuel absorbed in the canister 11, if the amount of deviation of the air-fuel ratio from the target air-fuel ratio becomes large, the update amount ΔKGPG of the concentration of fuel vapor becomes large and therefore the vapor concentration learning coefficient KGPGj becomes large as well.

The concentration of fuel vapor not proportional to the purge rate changes due for example to the amount of intake air, that is, the absolute pressure PM in the surge tank 5. Therefore, in the embodiment of the present invention, the engine operating region is divided into a plurality of parts, for example, eight, by the absolute pressure in the surge tank 5 and vapor concentration learning coefficients KGPGj (j=1, 2 . . . 8) are set for each of the operating regions.

In the embodiment of the present invention, the FGPG can be reduced after the purge action is started and the FGPG peaks. At this time, if the concentration of fuel vapor not proportional to the purge rate increases and the air-fuel ratio deviates from the target air-fuel ratio, the vapor concentration learning coefficient KGPGj is increased as shown in FIG. 3. By using this vapor concentration learning coefficient KGPGj to correct the amount of fuel injection in this way, even if the engine operating state changes, the air-fuel ratio will no longer deviate from the target air-fuel ratio.

Next, an explanation will be made of the routine for the control of the purge referring to FIG. 5 and FIG. 6. Note that this routine is executed by interruption every predetermined time interval.

Figure 5:
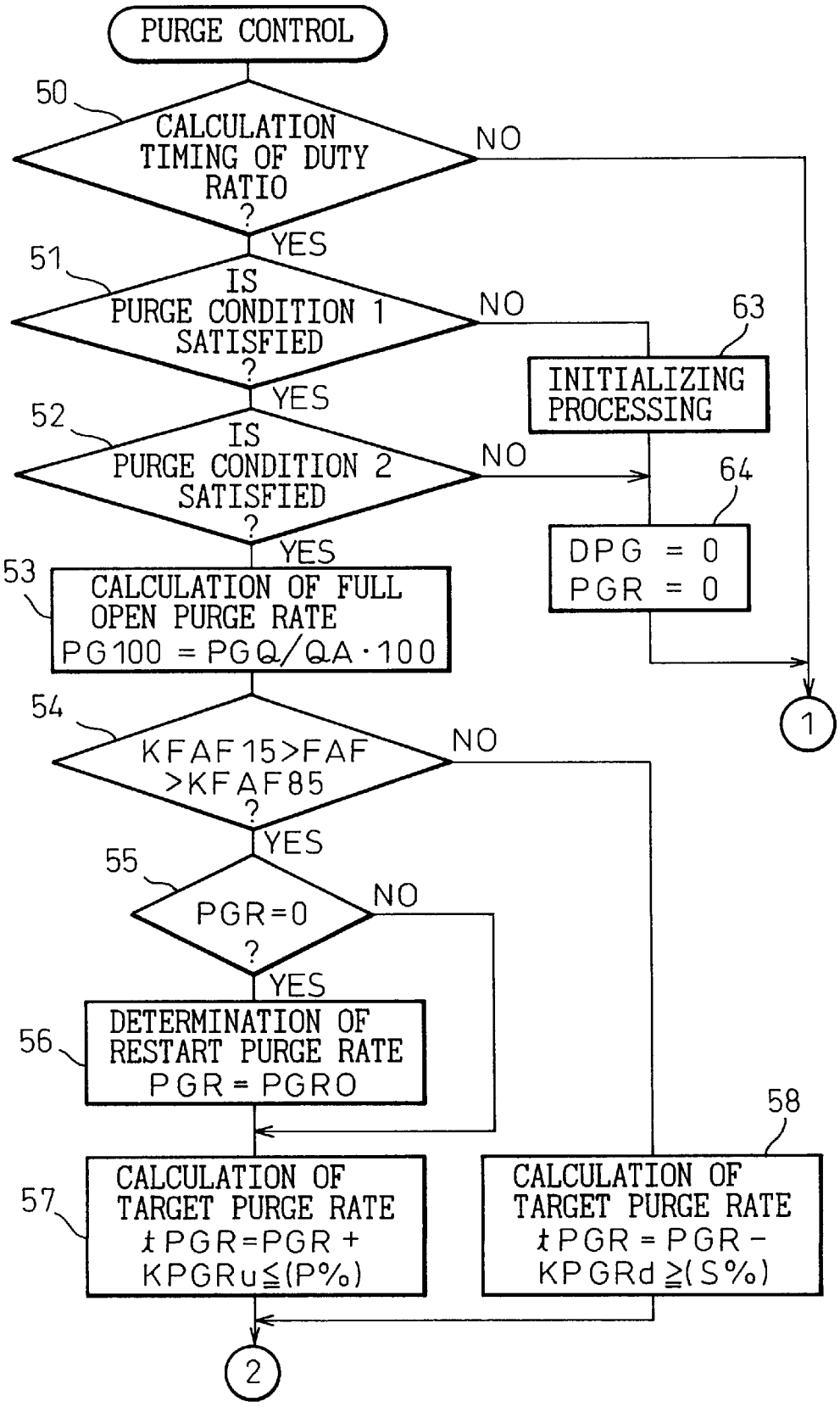
FIGS. 5 and 6 are flow charts of the purge control.
Figure 6:
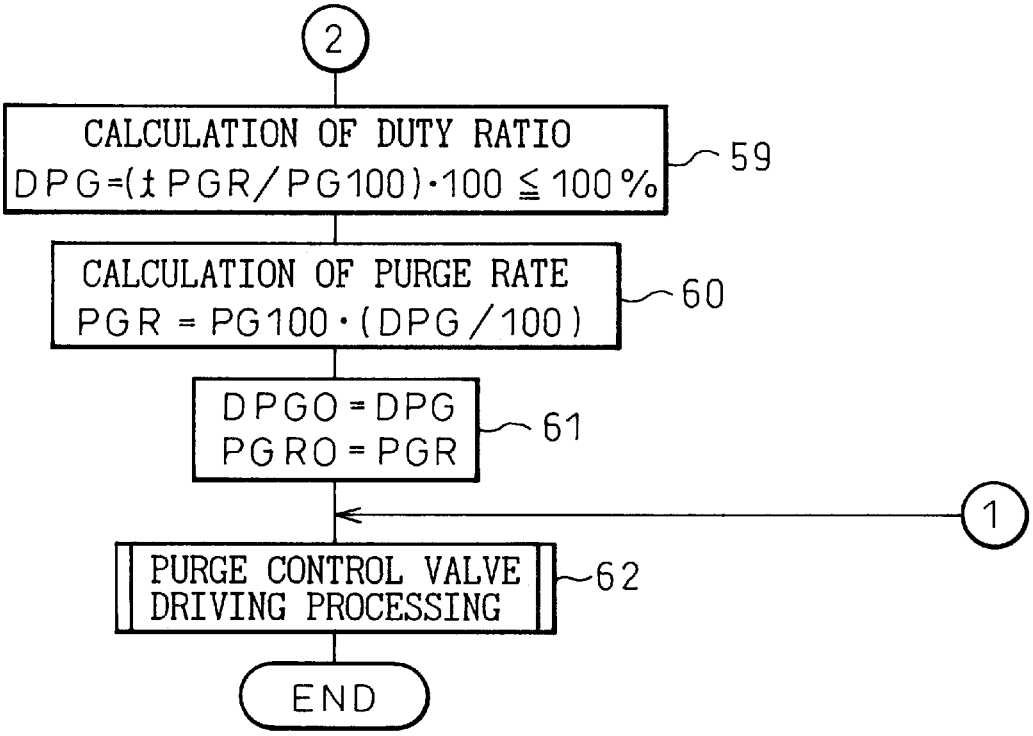

Referring to FIG. 5 and FIG. 6, first, at step 50, it is judged whether the time is the time of calculation of the duty ratio of the drive pulse of the purge control valve 17 or not. In the embodiment according to the present invention, the duty ratio is calculated every 100 msec. When not the time for calculation of the duty ratio, the routine jumps to step 62, where the processing for driving the purge control valve 17 is executed. As opposed to this, when it is the time for calculation of the duty ratio, the routine proceeds to step 51, where it is judged if the purge condition 1 is satisfied or not, that is, if a command for the start of the purge has been issued or not. When a command for the start of the purge not been issued, the routine proceeds to step 63, where the initialization processing is performed, then at step 64, the duty ratio DPG and the purge rate PGR are made zero. As opposed to this, when a command for the start of the purge has been issued, the routine proceeds to step 52, where it is judged if the purge condition 2 is satisfied or not, for example, whether feedback control of the air-fuel ratio is being performed or not. When the purge condition 2 is not satisfied, the routine proceeds to step 64, while when the purge condition 2 is satisfied, the routine proceeds to step 53.

At step 53, the ratio between the full open purge amount PGQ and the intake air amount QA, that is, the full open purge rate PG100 (=(PGQ/QA)·100), is calculated. Here, the full open purge amount PGQ shows the amount of purge when the purge control valve 17 is fully open. The full open purge rate PG100 is a function of the absolute pressure PM in the surge tank 5 and is found in advance by experiments. It is stored in advance in the ROM 22 in the form of a map as shown in the following table 1.

TABLE 1

| PM (mmHg) | 160 | 220 | 280 | 340 | 400 | 460 | 520 | 580 | 640 | 700 | 760 |
|---|---|---|---|---|---|---|---|---|---|---|---|
| PG100 | 25.6 | 25.6 | 21.6 | 15.0 | 11.4 | 8.6 | 6.3 | 4.3 | 2.8 | 0.8 | 0 |

The lower the absolute pressure PM in the surge tank 11 becomes, the larger the full open purge amount PGQ with respect to the intake air amount QA, so as shown in Table 1, the full open purge rate PG100 becomes larger the lower the absolute pressure PM in the surge tank 11.

Next, at step 54, it is judged if the feedback control coefficient FAF is between the upper limit KFAF15 (=1.15) and the lower limit KFAF85 (=0.85) or not. When KFAF15>FAF>KFAF85, that is, when the air-fuel ratio is being controlled by feedback to the stoichiometric air-fuel ratio, the routine proceeds to step 55, where it is judged if the purge rate PGR is zero or not. When the purge action is already being performed, PGR>0, so at this time the routine jumps to step 57. As opposed to this, further, when the purge action has not yet been started, the routine proceeds to step 56, where the purge rate PGR0 is made the restart purge rate PGR. When the purge condition 1 and the purge condition 2 are satisfied for the first time after the engine has started operating, the purge rate PGR0 is made zero by the initialization processing (step 63), so at this time PGR becomes 0. As opposed to this, when the purge action is stopped once and then the purge control is resumed, the purge rate PGR0 just before the purge control was stopped is made the restart purge rate PGR.

Next, at step 57, the target purge rate tPGR (=PGR+KPRGu) is calculated by adding a constant value KPGRu to the purge rate PGR. That is, when KFAF15>FAF>KFAF85, it is understood, the target purge rate tPGR is gradually increased every 100 msec. Note that an upper limit value P (P is for example 6%) is set for this target purge rate tPGR, therefore the target purge rate tPGR can only rise up to this upper limit value P. Next, the routine proceeds to step 59.

On the other hand, when it is judged at step 54 that FAF≧KFAF15 or FAF≦KFAF85, the routine proceeds to step 58, where the constant value KPGRd is subtracted from the purge rate PGR to calculate the target purge rate tPGR (=PGR−KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 59.

At step 59, the target purge rate tPGR is divided by the full open purge rate PG100 to calculate the duty ratio DPG (=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tTPG to the full open purge rate PG100. If the amount of opening of the purge control valve 17 is controlled in accordance with the ratio of the target purge rate tTPG to the full open purge rate PG100 in this way, no matter what purge rate the target purge rate tTPG is, regardless of the engine operating state, the actual purge rate will be maintained at the target purge rate.

Suppose for example that the target purge rate tTPG is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PG100 at the changed operating state becomes 5 percent, the duty ratio DPG of the duty ratio will become 40 percent and the actual purge ratio at this time will become 2 percent. That is, if the target purge rate tTPG is 2 percent, the actual purge rate will become 2 percent regardless of the engine operating state. If the target purge rate tTPG changes and becomes 4 percent, the actual purge rate will be maintained at 4 percent regardless of the engine operating state.

Next, at step 60, the full open rate PG100 is multiplied by the duty ratio DPG to calculate the actual purge rate PGR (=PG100·(DPG/100)). That is, as explained above, the duty ratio DPG is expressed by (tPGR/PG100)·100. In this case, when the target purge rate tPGR becomes larger than the full open purge rate PG100, the duty ratio PG would become more than 100 percent. The duty ratio DPG, however, cannot become more than 100 percent. At this time, the duty ratio DPG is made 100 percent, therefore the actual purge rate PGR becomes smaller than the target purge rate tPGR. Accordingly, the actual purge rate PGR is expressed by PG100·(DPG/100) as explained above.

Next, at step 61, the duty ratio DPG is made DPG0 and the purge rate PGR is made PGR0. Next, at step 62, processing is performed to drive the purge control valve 17. This drive processing is shown in FIG. 7, therefore, an explanation will next be made of the drive processing of FIG. 7.

Figure 7:
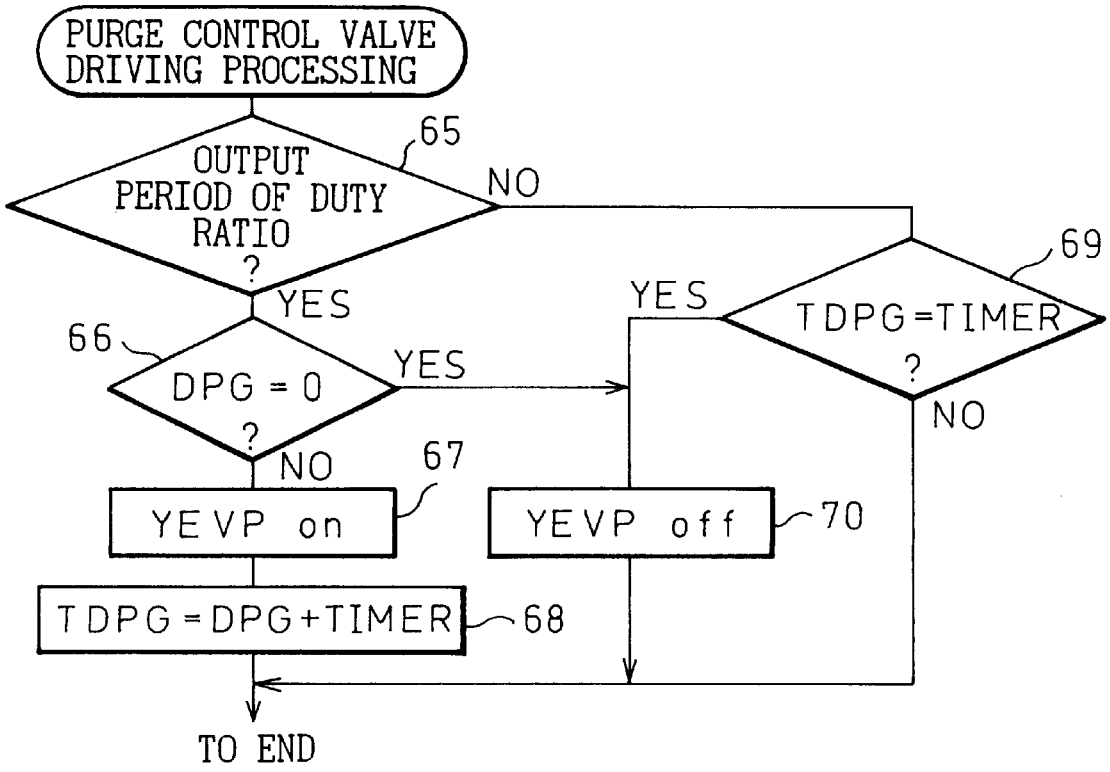
FIG. 7 is a flow chart of the processing for driving the purge control valve.

Referring to FIG. 7, first, at step 65, it is judged if the output period of the duty ratio, that is, the rising period of the drive pulse of the purge control valve 17, has arrived or not. The output period of the duty ratio is 100 msec. If the output period of the duty ratio has arrived, the routine proceeds to step 66, where it is judged if the duty ratio DPG is zero or not. When DPG is 0, the routine proceeds to step 70, where the drive pulse YEVP of the purge control valve 17 is turned off. As opposed to this, when DPG is not 0, the routine proceeds to step 67, where the drive pulse YEVP of the purge control valve 17 is turned on. Next, at step 68, the duty ratio DPG is added to the current time TIMER to calculate the off time TDPG of the drive pulse (=DPG+TIMER).

On the other hand, when it is judged at step 65 that the output period of the duty ratio has not arrived, the routine proceeds to step 69, where it is judged if the current time TIMER is the off time TDPG of the drive pulse. When TDPG=TIMER, the routine proceeds to step 70, where the drive pulse YEVP is turned off.

Next, the routine for calculation of the feedback control coefficient FAF shown in FIG. 8 will be explained. This routine is executed by interruption every predetermined interval for example.

Figure 8:
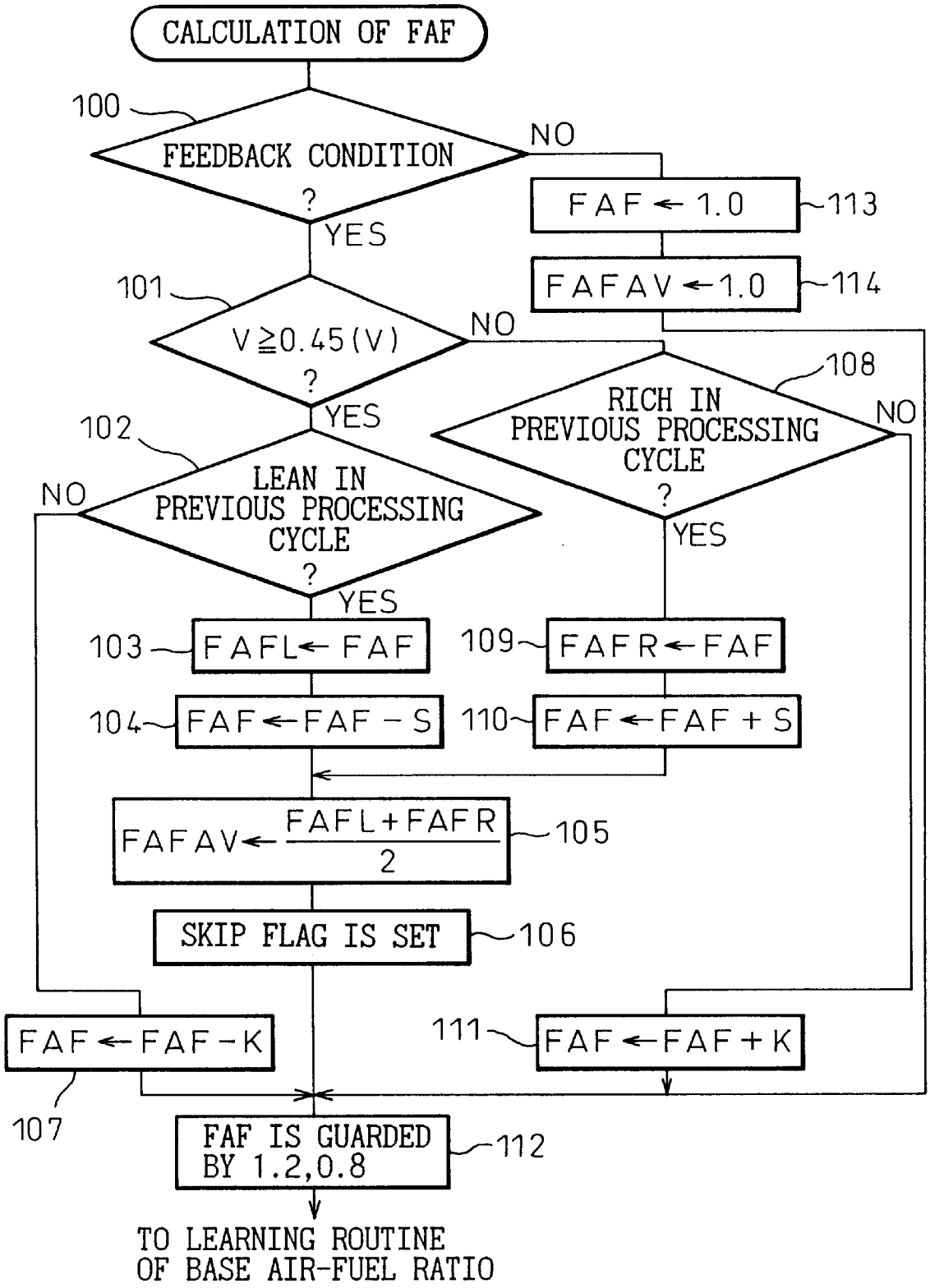
FIG. 8 is a flow chart of the calculation of the feedback control coefficient FAF.

Referring to FIG. 8, first, at step 100, it is judged if the feedback control conditions of the air-fuel ratio are satisfied or not. When the feedback control conditions are not satisfied, the routine proceeds to step 113, where the feedback control coefficient FAF is fixed to 1.0, then at step 114, the average value FAFAV of the feedback control coefficient is fixed to 1.0. Next, the routine proceeds to step 112. As opposed to this, when the feedback control conditions are satisfied, the routine proceeds to step 101.

At step 101, it is judged whether the output voltage of the $O_2$ sensor 31 is higher than 0.45 V or not, that is, whether the air-fuel ratio is rich or not. When $V \geqq 0.45$ V, that is, when the air-fuel ratio is rich, the routine proceeds to step 102, where it is judged if the air-fuel ratio was lean at the time of the previous processing cycle or not. When it was lean at the time of the previous processing cycle, that is, when it has changed from lean to rich, the routine proceeds to step 103, where the feedback control coefficient FAF is made FAFL and the routine proceeds to step 104. At step 104, a skip value S is subtracted from the feedback control coefficient FAF, therefore, as shown in FIG. 2, the feedback control coefficient FAF is rapidly reduced by the skip value S. Next, at step 105, the average value FAFAV of the FAFL and FAFR is calculated. Next, at step 106, the skip flag is set. Next, the routine proceeds to step 112. On the other hand, when it is judged at step 102 that the air-fuel ratio was rich at the time of the previous processing cycle, the routine proceeds to step 107, where the integral value K ($K \ll S$) is subtracted from the feedback control coefficient FAF, then the routine proceeds to step 112. Therefore, as shown in FIG. 2, the feedback control coefficient FAF is gradually reduced.

On the other hand, when it is judged at step 101 that $V < 0.45$ V, that is, when the air-fuel ratio is lean, the routine proceeds to step 108, where it is judged if the air-fuel ratio was rich at the time of the previous processing cycle. When it was rich at the time of the previous processing cycle, that is, when it changed from rich to lean, the routine proceeds to step 109, where the feedback control coefficient FAF is made FAFR and the routine proceeds to step 110. At step 110, the skip value S is added to the feedback control coefficient FAF, therefore, as shown in FIG. 2, the feedback control coefficient FAF is rapidly increased by exactly the skip value S. Next, at step 105, the average value FAFAV of the FAFL and FAFR is calculated. On the other hand, when it was judged at step 108 that the air-fuel ratio was lean at the time of the previous processing cycle, the routine proceeds to step 111, where the integral value K is added to the feedback control coefficient FAF. Therefore, as shown in FIG. 2, the feedback control coefficient FAF is gradually increased.

At step 112, the feedback control coefficient FAF is guarded by the upper limit 1.2 and the lower limit 0.8 of the allowable range of fluctuation. That is, the value of FAF is guarded so that FAF does not become larger than 1.2 and does not become smaller than 0.8. As explained above, when the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio.

Figure 9:
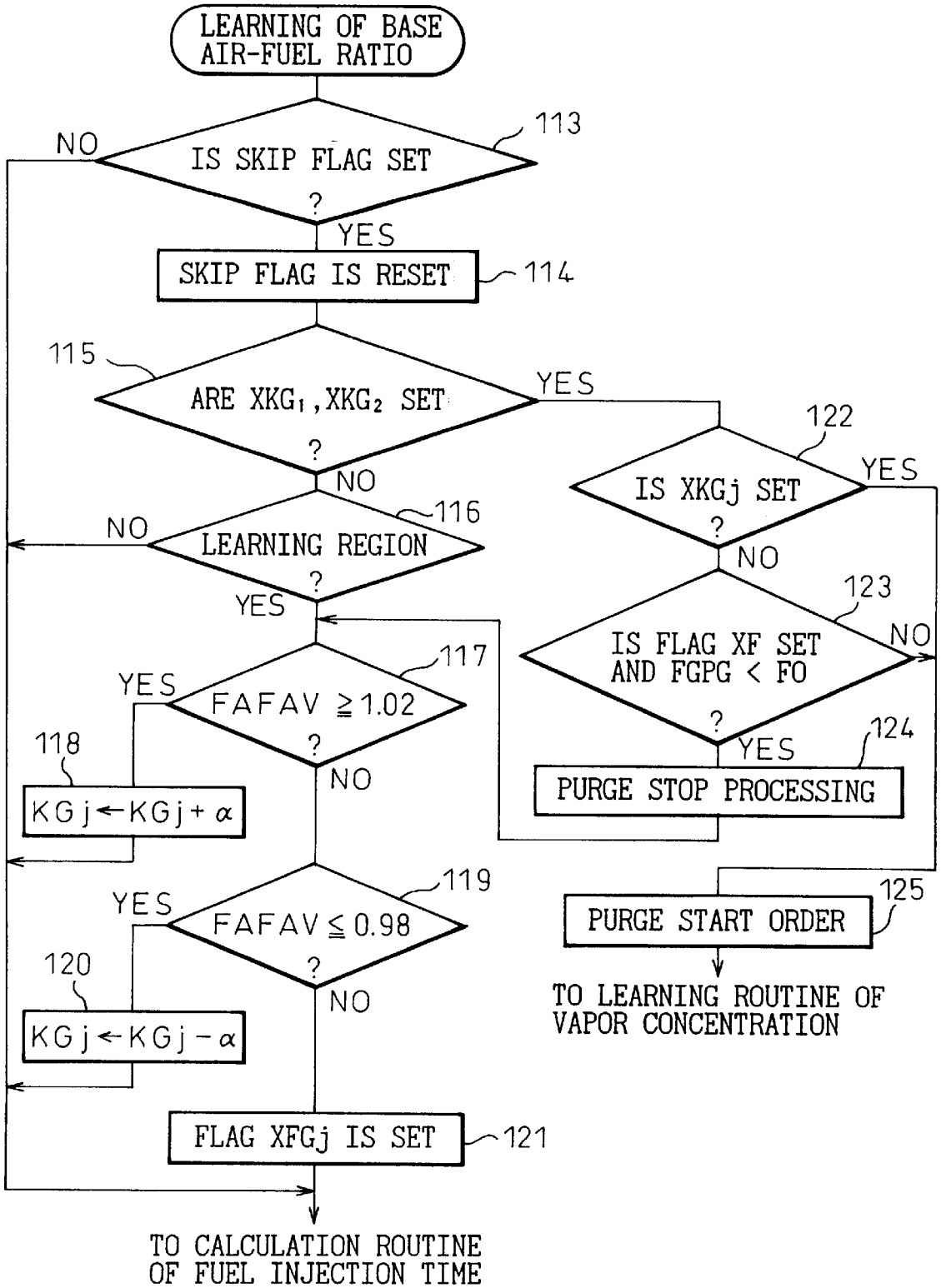
FIG. 9 is a flow chart of the learning of the air-fuel ratio.

When the routine for calculation of the feedback control coefficient FAF shown in FIG. 8 is completed, the routine for learning the air-fuel ratio shown in FIG. 9 is started.

Referring to FIG. 9, first, at step 113, it is judged if the skip flag has been set or not. When the skip flag has not been set, the routine proceeds to the routine for calculation of the fuel injection time shown in FIG. 14. As opposed to this, when the skip flag has been set, the routine proceeds to step 114, where the skip flag is reset, then the routine proceeds to step 115. That is, the routine proceeds to step 115 every time the feedback control coefficient FAF is made to skip.

At step 115, it is judged if the base air-fuel ratio learning completion flags $XKG_1$ and $XKG_2$ have been set or not. That is, in the embodiment of the present invention, a plurality, for example, eight, learning regions j are preset in accordance with the absolute pressure PM in the surge tank 11 and a learning values KGj of the base air-fuel ratio is set for each of the learning regions j. Note that one learning region (j=1)

of these learning regions j is made the learning region at the time of idling operation. Base air-fuel ratio learning completion flags XKGj are set for these learning regions j. When the learning of the base air-fuel ratio is completed for a learning region j, the corresponding base air-fuel ratio learning completion flag XKGj is set.

At step 115, it is judged if the base air-fuel ratio learning completion flag $XKG_1$ for the idling operation and the base air-fuel ratio learning completion flag $XKG_2$ for another of the learning regions (for example, j=2) have both been set. When these flags $XKG_1$ and $XKG_2$ have not both been set, the routine proceeds to step 116, where it is judged if the learning regions are those (j=1, 2) where the flags $XKG_1$ and $XKG_2$ are provided. If not the learning regions (j=1, 2), the routine proceeds to the routine for calculation of the fuel injection time shown in FIG. 14, while when the learning regions (j=1, 2), the routine proceeds to step 117. Note that at this time the purge action is not started yet.

At step 117, it is judged if the average value FAFAV of the feedback correction coefficient is larger than 1.02 or not. When FAFAV≧1.02, the routine proceeds to step 118, where a constant value α is added to the learning value KGj of the base air-fuel ratio for the learning region j. On the other hand, when it is judged that FAFAV<1.02 at step 117, the routine proceeds to step 119, where it is judged if the average value FAFAV of the feedback correction coefficient is smaller than 0.98 or no. When FAFAV≦0.98, the routine proceeds to step 120, where the constant value α is subtracted from the learning value KGj of the base air-fuel ratio for the learning region j. On the other hand, when it is judged that FAFAV>0.98 at step 119, that is, when FAFAV is between 0.98 and 1.02, it is judged that the learning of the base air-fuel ratio for the learning region j is completed. At this time, at step 121, the corresponding base air-fuel ratio learning completion flag XKGj is set.

When it is judged at step 115 that both of the base air-fuel ratio learning completion flags $XKG_1$ and $XKG_2$ are set, the routine proceeds to step 122, where it is judged if the base air-fuel ratio learning completion flag XKGj of the learning region j corresponding to the current operating state has been set or not. When the learning region corresponding to the current operating state is the learning region (j=1, 2), the flag XKGj has already been set, so the routine proceeds to step 125, where a purge start command is issued. On the other hand, when the learning region corresponding to the current operating state is another learning region (j=3, 4 . . . 8), the routine proceeds to step 123.

At step 123, it is judged if the flag XF has been set and the vapor concentration FGPG per unit purge rate is smaller than a setting F0 or not. As shown in FIG. 3, the flag XF is set after the FGPG peaks and starts to fall. Further, the setting F0 is a value of about 0.05 or considerably smaller than the peak value of FGPG. That is, when the purge is not started, the flag XF is not set, so the routine proceeds to step 125, where the purge start command is issued. Further, since the flag XF is not set even immediately after the start of the purge, the routine proceeds to step 125. On the other hand, when the flag XF has been set, FGPG has become small, and FGPG has become smaller than the setting F0, the routine proceeds to step 124, where the purge action is stopped once, then the routine proceeds to step 117. That is, for learning regions (j=3, 4 . . . 8) other than the learning regions (j=1, 2), the base air-fuel ratio is learned a little after the purge action is started. Therefore, the problem such as the typical second case explained above occurs in the learning regions (j=3, 4 . . . 8).

Figure 10:
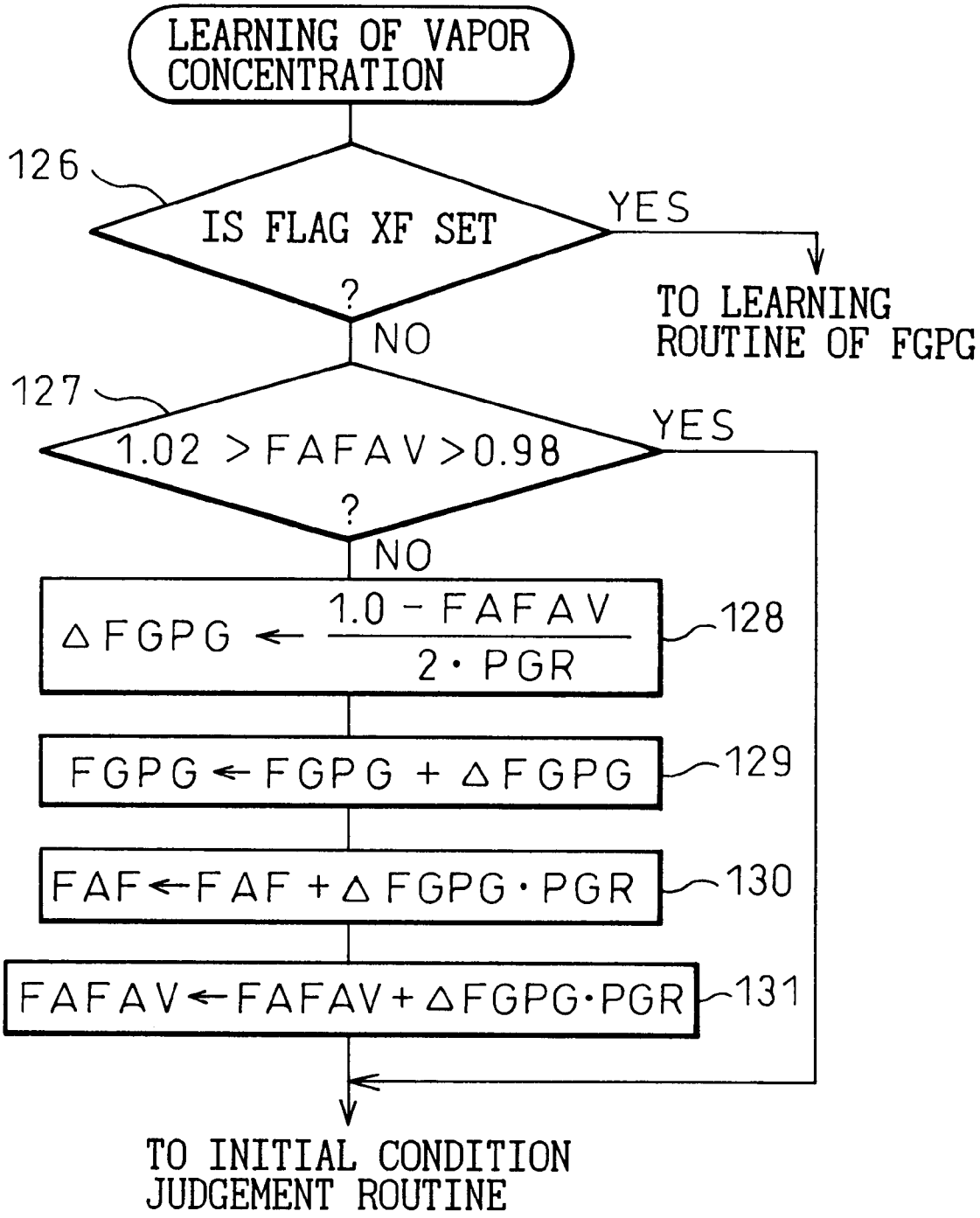
FIG. 10 is a flow chart of the learning of the concentration of vapor.

When a purge start command is issued at step 125, the purge action is started, then the routine enters the learning routine for the vapor concentration shown in FIG. 10.

Referring to FIG. 10, first, at step 126, it is judged if the above flag XF (FIG. 3) has been set or not. Immediately after the purge action is started, the flag XF is not set, therefore at this time the routine proceeds to step 127. At step 127, it is judged if the average value FAFAV of the feedback correction coefficient is between 0.98 and 1.02 or not. When FAFAV≧1.02 or FAFAV≦0.98, the routine proceeds to the routine for judgement of satisfaction of the initial conditions shown in FIG. 11. As opposed to this, when 1.02>FAFAV>0.98, the routine proceeds to step 128. From step 128 to step 131, the vapor concentration FGPG per unit purge rate is updated.

That is, at step 128, the update amount ΔFGPG of FGPG is calculated based on the following formula:

$$\Delta FGPG=(1.0-FAFAV)/(2\cdot PGR)$$

That is, half of the difference between 1.0 and FAFAV divided by the purge rate is made the update amount ΔFGPG. Next, at step 129, as shown in the following formula, the update amount ΔFGPG is added to FGPG.

$$FGPG=FGPG+\Delta FGPG$$

Next, at step 130, as shown in the following formula, the feedback correction coefficient FAF is corrected to approach 1.0 by the update portion (ΔFGPG·PGR) of the purge A/F correction coefficient FPG:

$$FAF=FAF+\Delta FGPG\cdot PGR$$

Next, at step 131, the average value FAFAV of the feedback correction coefficient is corrected by the update portion (ΔFGPG·PGR) of the purge A/F correction coefficient FPG.

Figure 11:
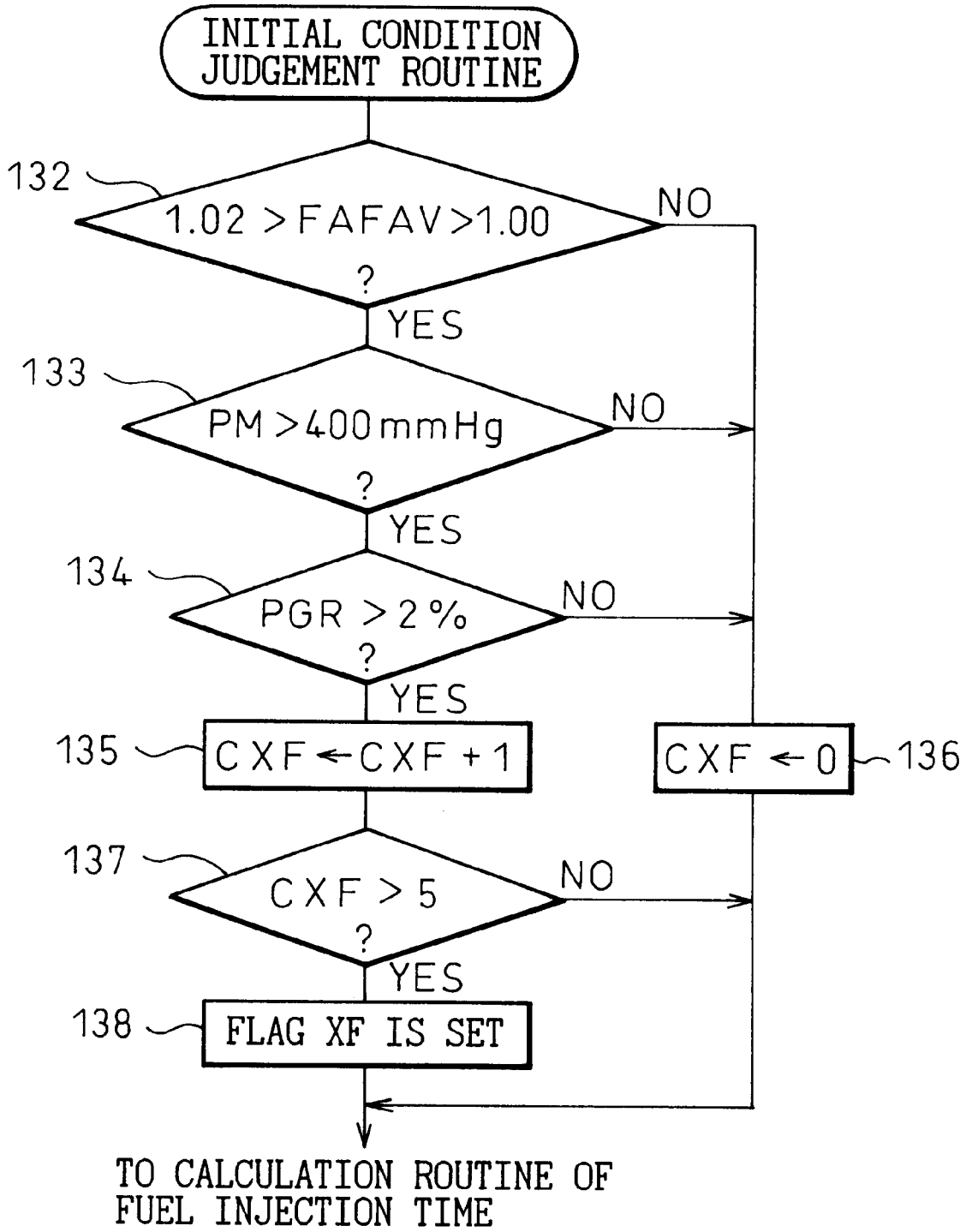
FIG. 11 is a flow chart of the judgement of the establishment of the initial conditions.

Next, the routine proceeds to the routine for judgement of the initial conditions shown in FIG. 11. The routine for judgement of the initial conditions is a routine for judging if the conditions for separately learning the concentration of the fuel vapor changing proportionally to the purge rate and the concentration of the fuel vapor changing without regard as to the purge rate are satisfied or not. Specifically, it is a routine for judging if FGPG has peaked and started falling.

Referring to FIG. 11, first, at step 132, it is judged if the average value FAFAV of the feedback correction coefficient is between 1.00 and 1.02 or not. When FAFAV≧1.02 or FAFAV≦1.00, the routine proceeds to step 136, where the count value CXF is made zero, then the routine proceeds to the routine for calculation of the fuel injection time shown in FIG. 14. As opposed to this, when 1.02>FAFAV>1.00, that is, when the air-fuel ratio is slightly lean, the routine proceeds to step 133, where it is judged if the absolute pressure PM in the surge tank 11 is larger than 400 mmHg or not. That is, when the evaporated fuel in the fuel tank 15 is pushed out into the intake passage, the small the amount of intake air, that is, the smaller than absolute pressure PM, the larger the concentration of the fuel vapor fluctuates. Therefore, to prevent this evaporated fuel from having any effect, at step 133 it is judged if the absolute pressure PM is large or not.

When PM≦400 mmHg, the routine proceeds to step 136, while when PM>400 mmHg, the routine proceeds to step 134. At step 134, it is judged if the purge rate PGR is over 2 percent or not. That is, this is because if the purge rate PGR is over 2 percent, FGPG may have peaked. When PGR≦2%, the routine proceeds to step 136, while when PGR>2%, the routine proceeds to step 135, where the count value CXF is incremented by exactly 1. Next, at step 137, it is judged if the count value CXF has become larger than 5 or not. When CXF>5, the routine proceeds to step 138, where the flag XF is set.

Figure 12:
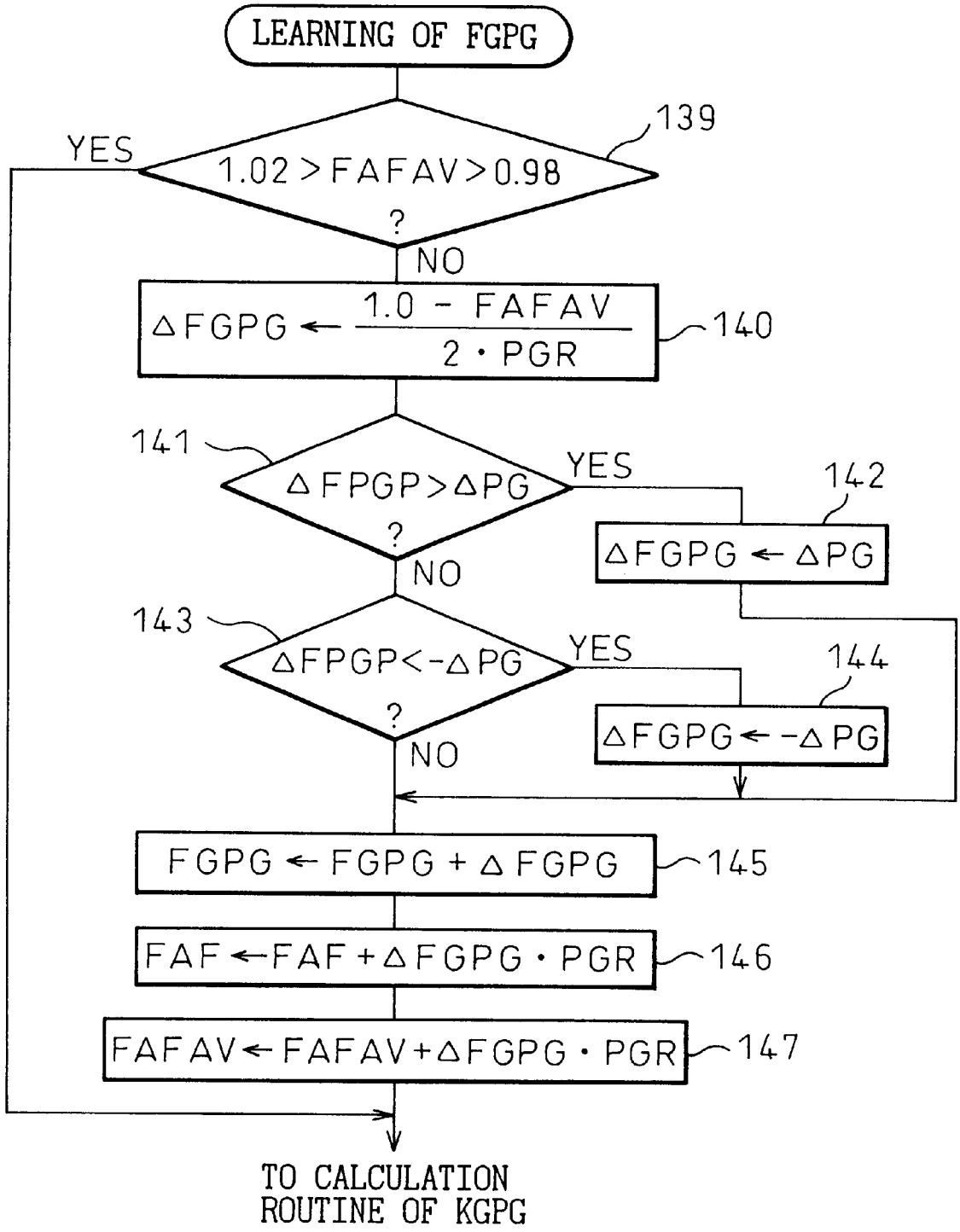
FIG. 12 is a flow chart of the learning of the FGPG.

When the flag XF is set, the routine proceeds from step 126 in FIG. 10 to the routine for learning the FGPG shown in FIG. 12. In this FGPG learning routine, FGPG is controlled to fall along with a fall in the amount of intake air in the canister 11.

That is, referring to FIG. 12, first, at step 139, it is judged if the average value FAFAV of the feedback correction coefficient is between 0.98 and 1.02 or not. When FAFAV≧1.02 or FAFAV≦0.98, the routine proceeds to the routine for calculation of KGPG shown in FIG. 13. As opposed to this, when 1.02>FAFAV>0.98, the routine proceeds to step 140, where the update amount ΔFGPG is calculated based on the following formula:

$$\Delta FGPG=(1.0-FAFAV)/(2\cdot PGR)$$

That is, half of the difference between 1.0 and FAFAV divided by the purge rate is made the update amount ΔFGPG. Next, at step 141, it is judged if the update amount ΔFGPG of FGPG is larger than the allowable range ΔPG shown in FIG. 4B. When ΔFGPG>ΔPG, the routine proceeds to step 142, where ΔFGPG is made ΔPG. That is, ΔFGPG is limited to within the allowable range ΔPG. Next, the routine proceeds to step 145. On the other hand, when it is judged at step 141 that ΔFGPG≦ΔPG, the routine proceeds to step 143, where it is judged if the update amount ΔFGPG of FGPG is smaller than the allowable range (−ΔPG) shown in FIG. 4B or not. When ΔFGPG<(−ΔPG), the routine proceeds to step 144, where ΔFGPG is made (−ΔPG). That is, ΔFGPG is limited to within the allowable range (−ΔPG). Next, the routine proceeds to step 145.

At step 145, as shown in the following formula, the update amount ΔFGPG is added to FGPG.

$$FGPG=FGPG+\Delta FGPG$$

Next, at step 146, as shown in the following formula, the feedback correction coefficient FAF is corrected to approach 1.0 by the update portion (ΔFGPG·PGR) of the purge A/F correction coefficient FPG:

$$FAF=FAF+\Delta FGPG\cdot PGR$$

Next, at step 147, the average value FAFAV of the feedback correction coefficient is corrected by the update portion (ΔFGPG·PGR) of the purge A/F correction coefficient FPG.

Next, the routine for calculation of the vapor concentration learning coefficient KGPGj shown in FIG. 13 will be explained. In this routine, the vapor concentration changing without regard to the purge rate is learned.

Figure 13:
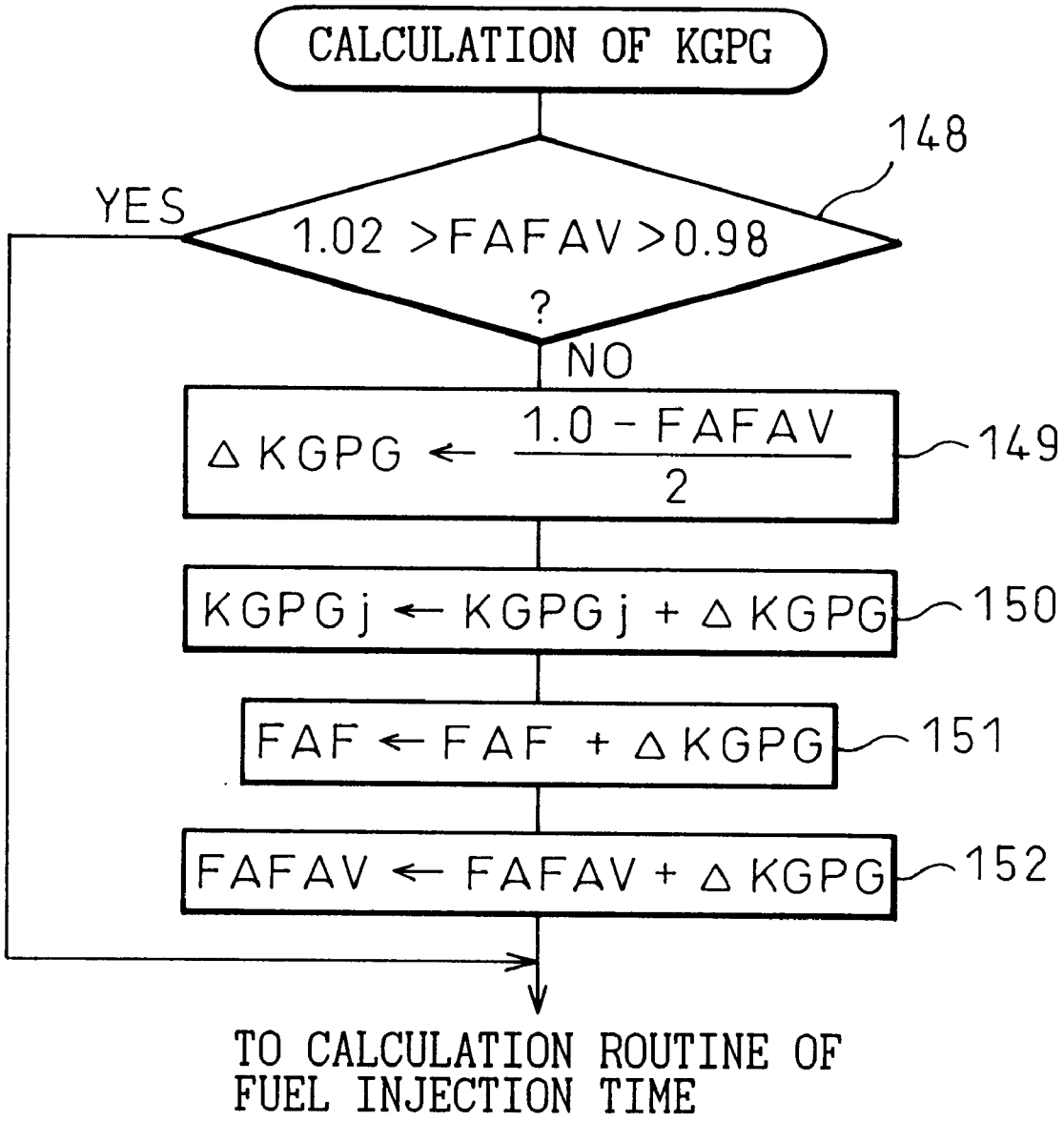
FIG. 13 is a flow chart of the calculation of the KGPG.

Referring to FIG. 13, first, at step 148, it is judged if the average value FAFAV of the feedback correction coefficient is between 0.98 and 1.02 or not. When FAFAV≧1.02 or FAFAV≦0.98, the routine proceeds to the routine for calculation of the fuel injection time shown in FIG. 14. As opposed to this, when 1.02>FAFAV>0.98, the routine proceeds to step 149, where the update amount ΔKGPG of KGPGj is calculated based on the following formula:

$$\Delta KGPG=(1.0-FAFAV)/2$$

That is, half of the difference between 1.0 and FAFAV is made the update amount ΔFGPG. Next, as shown in the following formula, at step 150, the update amount ΔKGPG is added to KGPGj:

$$KGPGj=KGPGj+\Delta KGPG$$

Next, at step 151, as shown in the following formula, the feedback correction coefficient FAF is corrected to approach 1.0 by the update portion ΔKGPG of KGPGj:

$$FAF=FAF+\Delta KGPG$$

Next, at step 152, the average value FAFAV of the feedback correction coefficient is corrected by the update portion ΔKGPG of KGPGj. Next, the routine proceeds to the routine for calculation of the fuel injection time shown in FIG. 14.

Figure 14:
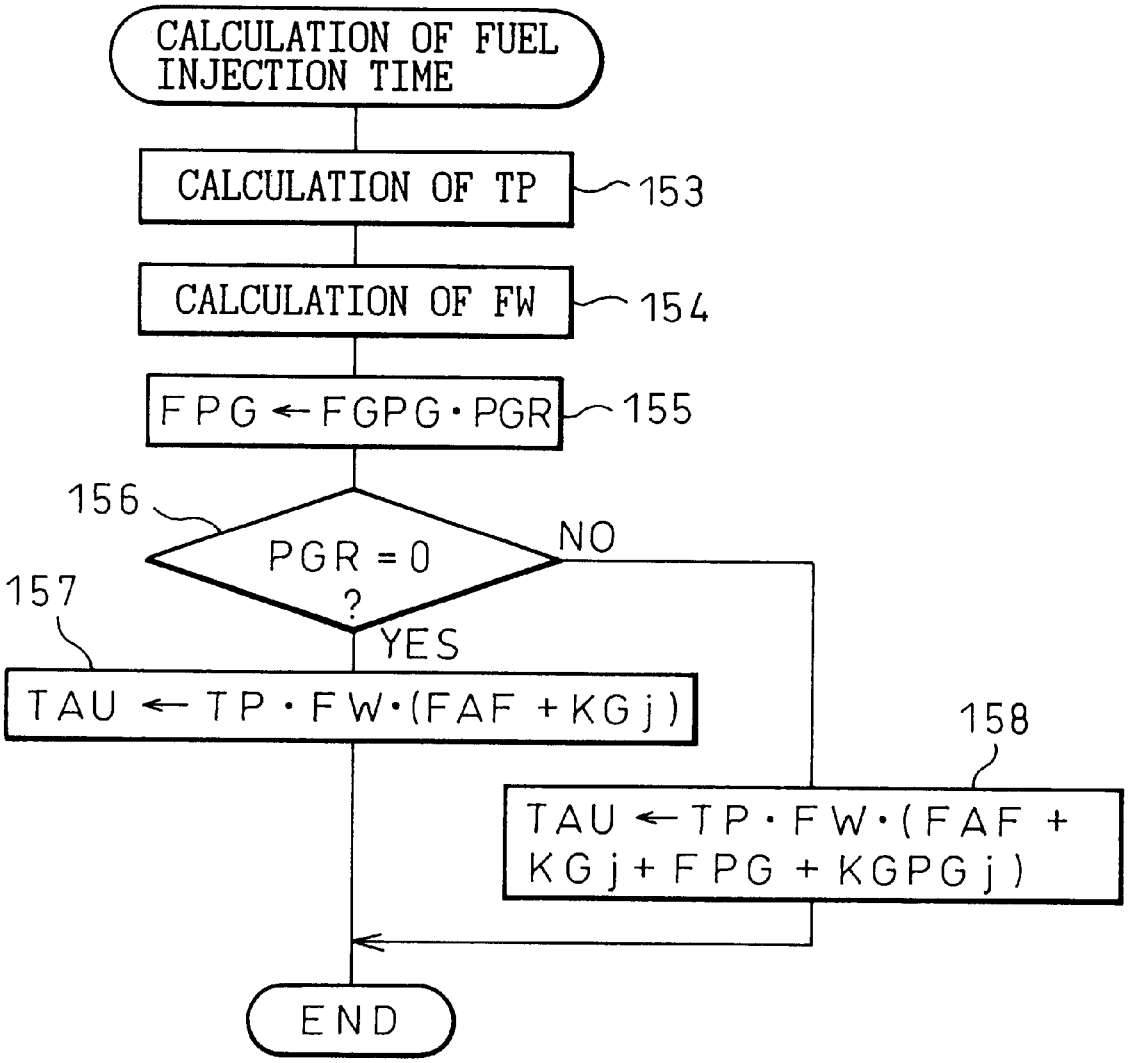
FIG. 14 is a flow chart of the calculation of the fuel injection time.

Referring to FIG. 14, first, at step 153, the basic fuel injection time TP is calculated based on the absolute pressure PM in the surge tank 5 and the engine speed N. Next, at step 154, the correction coefficient FW for the increase for engine warmup etc. is calculated. Next, at step 155, the purge A/F correction coefficient FPG (=FGPG·PGR) is calculated by multiplying the purge rate PGR with the vapor concentration FGPG per unit purge rate. Next, at step 156, it is judged if the purge rate PGR is zero or not. When PRG=0, that is, when the purge action has been stopped, the routine proceeds to step 157, where the fuel injection time TAU is calculated based on the following formula:

$$TAU=TP\cdot FW\cdot(FAF+KGj)$$

As opposed to this, when PGR is not zero, that is, a purge action is being performed, the routine proceeds to step 158, where the fuel injection time TAU is calculated based on the following formula:

$$TAU=TP\cdot FW\cdot(FAF+KGj+FPG+KGPGj)$$

Note that the base air-fuel ratio learning coefficient KGj is stored in a backup RAM (not shown), while the vapor concentration learning coefficient KGPGj is stored in the RAM 23. Therefore, KGj continues to be stored even when the engine is stopped, while KGPGj is cleared when the engine is stopped.

According to the present invention, as mentioned above, it is possible to suppress fluctuations of the air-fuel ratio due to changes in the concentration of the fuel vapor.

While the invention has been described by reference to specific embodiments chosen for purposes of illustration, it should be apparent that numerous modifications could be made thereto by those skilled in the art without departing from the basic concept and scope of the invention.

I claim:

1. An evaporated fuel treatment device for an engine provided with an intake passage, comprising:

a canister containing activated carbon for temporarily storing evaporated fuel;

a purge control valve for controlling an amount of purge of fuel vapor to be purged from the canister into the intake passage, the concentration of the fuel vapor which is purged being divided into a first fuel vapor concentration which changes proportionally to a purge rate of the fuel vapor and a second fuel vapor concentration which changes without regard as to the purge rate of the fuel vapor;

air-fuel ratio detecting means for detecting the air-fuel ratio;

feedback control means for feedback control of the air-fuel ratio so that the air-fuel ratio becomes a target air-fuel ratio;

fuel vapor concentration reducing means for reducing the first fuel vapor concentration per unit purge rate to follow a reduction in the amount of fuel absorbed in the canister when the fuel vapor is being purged;

fuel vapor concentration calculating means for calculating the second fuel vapor concentration from the amount of deviation of the air-fuel ratio from the target air-fuel ratio caused when reducing the first fuel vapor concentration per unit purge rate by the fuel vapor concentration reducing means; and correcting means for correcting an amount of fuel supplied based on the first fuel vapor concentration and the second fuel vapor concentration.

2. An evaporated fuel treatment device for an engine as set forth in claim 1, wherein said feedback control means controls the air-fuel ratio to the target air-fuel ratio by correcting the amount of fuel supplied by a feedback correction coefficient which changes in accordance with the air-fuel ratio detected by the air-fuel ratio detecting means, said feedback correction coefficient changes about a predetermined reference value when the air-fuel ratio is being maintained at the target air-fuel ratio.

3. An evaporated fuel treatment device for an engine as set forth in claim 1, wherein said first fuel vapor concentration per unit purge rate is calculated based on an amount of deviation of the air-fuel ratio from the target air-fuel ratio and said fuel vapor concentration reducing means reduces the first fuel vapor concentration per unit purge rate calculated based on the amount of deviation of the air-fuel ratio from the target air-fuel ratio to follow a reduction in the amount of fuel absorbed in the canister.

4. An evaporated fuel treatment device for an engine as set forth in claim 3, wherein said fuel vapor concentration reducing means reduces the first fuel vapor concentration per unit purge rate to follow a reduction in the amount of fuel absorbed in the canister by limiting an amount of update of the first fuel vapor concentration per unit purge rate calculated based on the amount of deviation of the air-fuel ratio from the target air-fuel ratio to within a predetermined allowable range.

5. An evaporated fuel treatment device for an engine as set forth in claim 4, wherein said predetermined allowable range is made narrower the smaller the first fuel vapor concentration per unit purge rate and the amount of update is limited to a value smaller the smaller the first fuel vapor concentration per unit purge rate.

6. An evaporated fuel treatment device for an engine as set forth in claim 1, wherein the operating region of the engine is divided into a plurality of operating regions, said fuel vapor concentration calculating means calculates a learning value of the second fuel vapor concentration for each operating region formed, and said correcting means corrects the amount of fuel supplied on the basis of the first fuel vapor concentration and the learning value of the second fuel vapor concentration calculated for each operating region.

7. An evaporated fuel treatment device for an engine as set forth in claim 1, wherein a learning value of a base air-fuel ratio is calculated based on the amount of deviation of the air-fuel ratio from the target air-fuel ratio before the purge action of the fuel vapor is started for the first time after the start of engine operation and wherein the purge action of the fuel vapor is started after the learning value of the base air-fuel ratio is calculated.

8. An evaporated fuel treatment device for an engine as set forth in claim 1, wherein the operating region of the engine is divided into a plurality of operating regions, a learning value of the base air-fuel ratio is calculated for each operating region formed, and the purge action of the fuel vapor is started when the learning values of the base air-fuel ratios of some of the operating regions have been calculated.

9. An evaporated fuel treatment device for an engine as set forth in claim 8, wherein idling operation is included in said some of the operating regions.

10. An evaporated fuel treatment device for an engine as set forth in claim 8, wherein the learning value of the base air-fuel ratio is calculated for the operating regions other than said some operating regions after the purge action of the fuel vapor is started and wherein the purge action of the fuel vapor is temporarily stopped when calculating the learning value of the base air-fuel ratio for the operating regions other than said some operating regions.

11. An evaporated fuel treatment device for an engine as set forth in claim 1, wherein, when the purge action of the fuel vapor is started for the first time after the engine operation starts, the fuel vapor concentration is calculated in a combined form including both the first fuel vapor concentration and the second fuel vapor concentration on the basis of the amount of deviation of the air-fuel ratio until a predetermined time elapses from when the purge action of the fuel vapor is started and the amount of fuel supplied is corrected based on the fuel vapor concentration and wherein, after the predetermined time elapses from when the purge action of the fuel vapor is started, the fuel vapor concentration is divided into the first fuel vapor concentration and the second fuel vapor concentration and the amount of fuel supplied is corrected based on the first fuel vapor concentration and the second fuel vapor concentration.

12. An evaporated fuel treatment device for an engine as set forth in claim 11, wherein it is judged that the predetermined time has elapsed when the fuel vapor concentration calculated in a combined form including both the first fuel vapor concentration and the second fuel vapor concentration starts to fall.

13. An evaporated fuel treatment device for an engine as set forth in claim 1, wherein the opening of the purge control valve is controlled so that the purge rate of the fuel vapor becomes a predetermined target purge rate.

14. An evaporated fuel treatment device for an engine as set forth in claim 13, wherein means is provided for finding a full open purge rate for when the purge control valve is fully open and the opening of the purge control valve is decided by dividing the target purge rate by the full open purge rate.

* * * * *